United States Patent [19]

McCullough, Jr. et al.

[11] Patent Number: 4,997,716

[45] Date of Patent: Mar. 5, 1991

[54] FIRE SHIELDING COMPOSITE STRUCTURES

[75] Inventors: Francis P. McCullough, Jr., Lake Jackson; R. Vernon Snelgrove, Damon; Frank W. Hale, Lake Jackson, all of Tex.; Jeanne M. Giroux, Midland, Mich.; David M. Hall, Auburn, Ala.

[73] Assignee: The Dow Chemical Company, Midland, Mich.

[21] Appl. No.: 285,155

[22] Filed: Dec. 16, 1988

Related U.S. Application Data

[63] Continuation-in-part of Ser. No. 206,634, Jun. 14, 1988, which is a continuation-in-part of Ser. No. 114,324, Oct. 28, 1987, Pat. No. 4,879,168.

[51] Int. Cl.[5] ..... B32B 9/04

[52] U.S. Cl. ..... 428/411.1; 428/284; 428/285; 428/286; 428/288; 428/292; 428/367; 428/408; 428/457

[58] Field of Search ..... 428/367, 408, 288, 292, 428/371, 362, 369; 423/447.1, 447.2

[56] References Cited

U.S. PATENT DOCUMENTS

| | | | |
|---|---|---|---|
| 3,993,829 | 11/1976 | Park | 428/408 X |
| 4,356,228 | 10/1982 | Kobayashi et al. | 428/408 X |
| 4,460,650 | 7/1984 | Ogawa et al. | 428/394 X |
| 4,783,349 | 11/1988 | Cogswell et al. | 428/367 X |
| 4,788,104 | 11/1988 | Adriaensen et al. | 428/367 X |

OTHER PUBLICATIONS

PCT 86/06110 published 10/23/86 by McCullough et al.

*Primary Examiner*—Lorraine T. Kendell

[57] ABSTRACT

A fire retarding and fire shielding structural panel for a vehicle, comprising at least one compressed composite composed of a thermoplastic or thermosetting resin matrix containing a multiplicity of non-flammable carbonaceous fibers.

7 Claims, 1 Drawing Sheet

FIG. 1
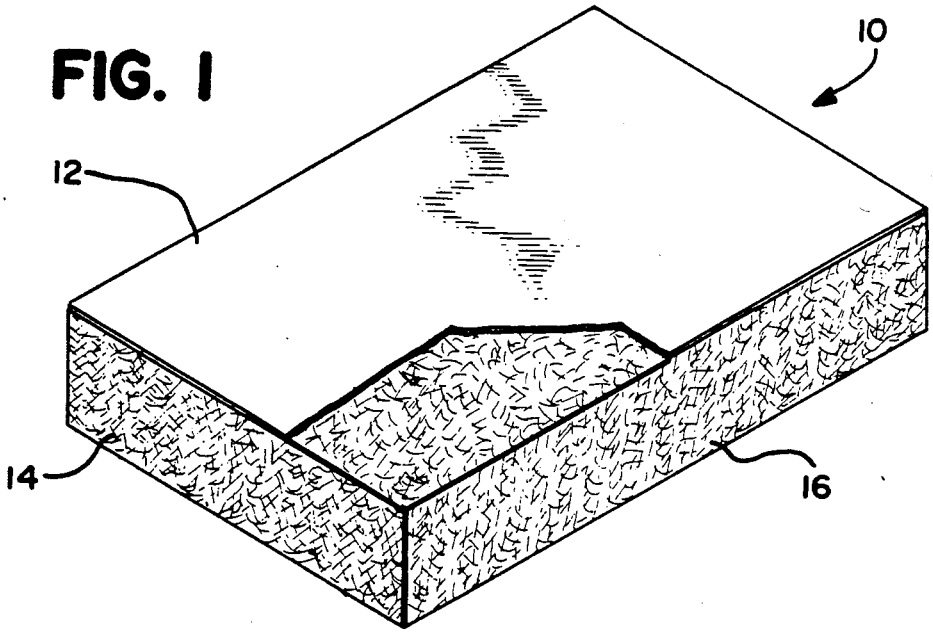
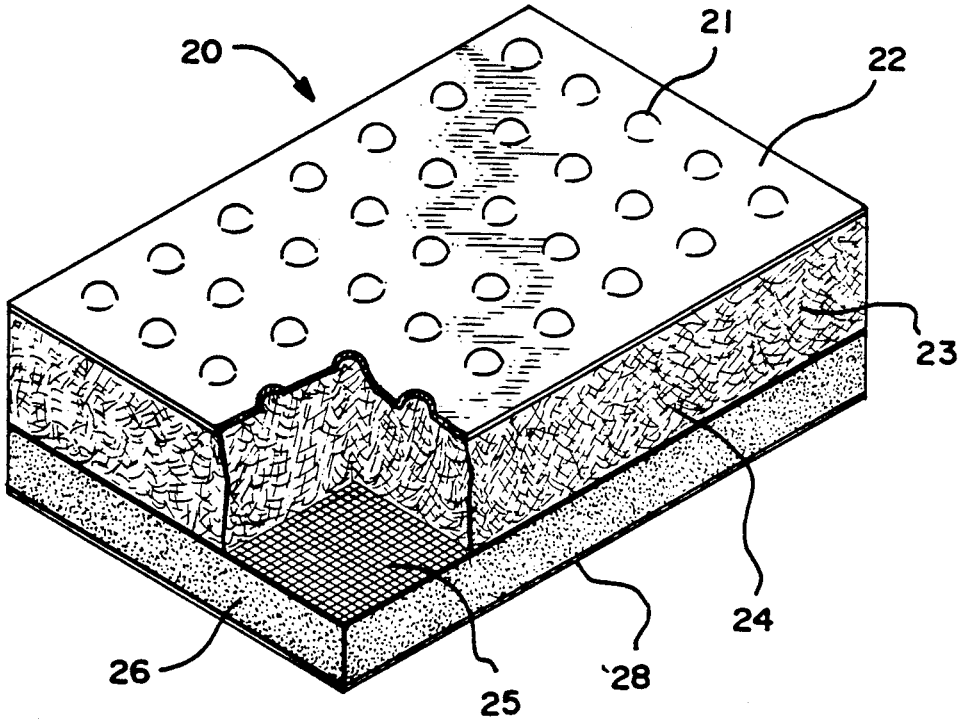
FIG. 2

FIRE SHIELDING COMPOSITE STRUCTURES

RELATED APPLICATION

This application is a continuation-in-part of application Ser. No. 206,634, filed Jun. 14, 1988, which is a continuation-in-part of application Ser. No. 114,324, filed Oct. 28, 1987, of McCullough et al, now U.S. Pat. No. 4,879,168.

FIELD OF THE INVENTION

This invention relates to lightweight, flexible, fire retardant, radiation and fire shielding carbonaceous fiber reinforced compressed composite structures. More particularly, the invention relates to structural members for vehicles and installations which comprises at least one compressed, carbonaceous fiber reinforced resinous composite.

BACKGROUND OF THE INVENTION

The use of prefabricated structures or panels for constructing interiors in airplanes and automobiles is universally accepted. However, there is still a need to provide structural members which are lightweight, flame retardant, fire shielding and easy to manufacture.

Fiber reinforced composite structures comprising a binder phase and a fiber reinforcing phase are well known articles of commerce which have been employed in various engineering applications because of their very high strength-to-weight ratio, that is, tensile strength divided by specific gravity. Because of the anisotropic character of these substances, the strengths of both the reinforcing fiber and the binder material are of significance, with the fiber contributing the major portion. The binder materials, which can be thermosetting or thermoplastic, are selected on the basis of their adhesiveness, fatigue resistance, heat resistance, chemical resistance, moisture resistance, and the like.

At the present there are poor radiation barriers utilized on aircraft. Radiation induced flash over and smoke are amongst the chief causes of death in airplane accidents.

It is desired to provide novel compressed composite materials directed to a resin matrix reinforced with a carbonaceous fiber which possesses high strength and fire retarding or fire shielding characteristics.

It is further desired to provide compressed fibrous reinforced composites which can be fabricated into different structural shapes without fiber breakage.

The compressed composites of the invention are an improvement over composites which are extruded, molded or cast by providing improved fire retarding and fire shielding properties.

SUMMARY OF THE INVENTION

The present invention is directed to a fire shielding composition of a fiber reinforced composite material comprising a resin matrix and a multiplicity of nonlinear carbonaceous fibrous materials which is formed by compressive forces. More particularly, the present invention is concerned with a compressed composite material comprising a resin matrix with a reinforcement of a multiplicity of non-flammable carbonaceous fibers having an L.O.I. value greater than 40. Advantageously, the fibers have a reversible deflection ratio of greater than 1.2:1 and an aspect ratio (1/d) greater than 10:1.

The resinous matrix may comprise thermoplastic or heat cured thermosetting material.

In accordance with one embodiment of the invention, the composites of the invention are prepared by the compression of a thermoplastic or thermosetting resin together with a batting or fluff of carbonaceous fibers. The composite may be cold compressed or the combination of heat and compression may be utilized depending upon the resin. Advantageously, the compression results in fibers being on the surface of the composite. The panels of the invention may comprise one or more composites laminated together to form a single unit.

Another embodiment of the invention comprises a structure wherein the carbonaceous fibers are on one or more sides of the panel to provide sound and thermal insulation.

BRIEF DESCRIPTION OF THE DRAWINGS

FIG. 1 is a perspective view partially in cross-section of a composite panel of the invention, and FIG. 2 is a perspective view of a structural member of the invention with a sound absorbing barrier layer.

DETAILED DESCRIPTION OF THE PREFERRED EMBODIMENTS

The present invention in its broadest scope is directed to a composite which comprises a synthetic resin such as thermoplastic or heat set thermosetting resins which is compressed together with non-flammable carbonaceous fiber having an L.O.I. value greater than 40. The composite of this invention will be useful particularly in forming fire retardant or fire shielding structural panels for use in vehicles and installations, particularly airplanes.

Advantageously, the composites of the present invention contain about 10 to 95% by weight non-linear, non-flammable resilient elongatable carbonaceous fibers having a reversible deflection ratio of greater than about 1.2:1 and an aspect ratio (1/d) of greater than 10:1. In a preferred embodiment, the carbonaceous fibers possess a sinusoidal or coil-like configuration or a more complicated structural combination of the two. About 10 to 95% by weight of the carbonaceous fibers are used in fabricating the composite, preferably 20–75% by weight of composite. The carbonaceous fibers which may be employed and their method of preparation are those described in U.S. patent application Ser. No. 856,305, entitled "Carbonaceous Fibers with Spring-like Reversible Reflection and Method of Manufacture", filed Apr. 28, 1986, by McCullough et al., now abandoned; incorporated herein by reference and as described in U.S. patent application Ser. No. 918,738, entitled "Sound and Thermal Insulation", filed Oct. 14, 1986, by McCullough et al., now abandoned; incorporated herein by reference.

The synthetic resin used in the composites of the present invention may be selected from any of the conventional type resin materials such as thermoplastic resins and thermosetting resins.

Thermoplastic resins, for example, may include polyethylene, ethylenevinyl acetate copolymers, polypropylene, polystyrene, polyvinyl chloride, polyvinyl acetate, polymethacrylate, acrylonitrile-butadiene-styrene copolymers (ABS), polyphenylene oxide (PPO), modified PPO, polycarbonate, polyacetal, polyamide, polysulfone, polyether sulfone, polyolefins, polyacrylonitrile, polyvinylidene chloride, polyvinyl acetate, polyvinyl alcohol, polyvinyl pyrrolidone, ethyl cellulose, polyvinyl chloridevinyl acetate copolymer, polyacrylonitrile-styrene copolymer, polyacrylonitrile-vinyl chloride copolymer, carboxymethylcellulose, etc., polyparaxylene, polyimide, polyamide-imide, polyester imide, polybenzimidazole, polyoxadiazole, and the like.

Thermosetting resins, for example, may include phenolic resins, urea resin, melamine resin, alkyd resin, vinyl ester resins, polyester resin, xylene resins, furanic resins, and the like.

Other suitable resinous materials are disclosed in *Modern Plastics Encyclopedia,* 1984–85, Vol. 61, No. 10A, McGraw-Hill, New York, N.Y., which is herewith incorporated by reference.

As shown in FIG. 1, the composite of the invention in its simplest form comprises a panel member 10 comprising a resin matrix 16 with carbonaceous fibers having a plastic or metallic film 12 which may form a vapor barrier or decorative cover. The film 12 may be compressed onto the panel during the compression forming operation.

In FIG. 2, there is shown a structure 20 which is particularly useful as a panel for the interior of airplanes. The structure 20 comprises at least one resinous matrix 24 having 20–50% by weight of non-linear carbonaceous fibers 23 incorporated therein that is formed by heat and pressure application. On its upper surface a plastic film 22, which is preferably Mylar is attached. The film advantageously may be provided with a decorative embossment 21. On the other side of the matrix 24 there may be provided a stiffening member 25 which may be in the form of a screen, grate, etc. The use of the stiffening member is dependent upon several factors including the type of resin, the amount of fiber content and the environment that the structure is utilized. A fluff 26 of non-linear and/or linear carbonaceous fibers which is covered by a foil 28 may be provided when thermal and sound insulation is also desirable. The composite may be prepared by enclosing a fluff of carbonaceous fibers between sheets of plastic material, heating to the softening point and subjecting the mixture to compressive forces of about several hundred to several thousand pounds per square feet depending upon the thickness of the composite desired and the utilization contemplated.

The resinous matrix as well as the thermal and sound insulating materials may contain biostabilizers such as tributyl tin and its derivatives, copper-bis(8-hydroxyquinoline) and the like.

The preferred resin for forming airplane panel structures are the commercial polyesters such as the polyethylenes sold by Eastman Chemical Products under the trademark KODEL 410, 411 and 431, and DACRON 262 and 124W of E. I. du Pont de Nemours.

In the preferred embodiment of this invention, the polymer resin includes the carbonaceous fibers in the form of a fluff or batting of fibers such as described in U.S. patent application Ser. No. 918,738, entitled "Sound and Thermal Insulation", filed Oct. 14, 1986, by McCullough et al., now abandoned above.

The carbonaceous fibers of the present invention may be blended with other synthetic or natural fibers. Examples of the other reinforcing and/or conductive fibers that may be used include other carbonaceous or carbon fibers, cotton, wool, polyester, polyolefin, nylon, rayon, asbestos, glass fibers, fibers of silica, silica alumina, potassium titanate, silicon carbide, silicon nitride, boron nitride, boron, acrylic fibers, tetrafluoroethylene fibers, polyamide fibers, vinyl fibers, protein fibers, ceramic fibers such as aluminum silicate, and oxide fibers such as boron oxide, thoria and zirconia.

Once the fibers or fiber assemblies are produced they can be incorporated into the polymer resin matrix to produce various composite structures in substantially any fabricated form. For example, the fiber/polymer composite material of the present invention may be in the form of a sheet. Preferably, about ¼" to ½" thickness, or a three-dimensional shaped article suitable for ultimate use.

Many combinations of composites and structures are possible in this invention. The compositions prepared for a specific application will depend on the mechanical properties desired by the end-user. Generally, it is believed that fiber loadings between 10 and 75% by weight are preferably used, in combination with the resins. The fiber preferred in this invention are those with maximum elongation and electrical conductivities below about $10^3$ ohms.

It is advantageous that the length of individual fibers be in the range of 0.5 to 20 mm, preferably, in the range of 2 to 10 mm. If the length is less than 0.5 mm, the strength of the composite is lowered to an unsatisfactory level due to an excessively small aspect ratio (1/d) of the fibers. The diameter of the carbon fibers of the invention preferably have diameters ranging within 2 to 25 microns, more preferably 4 to 12 microns.

The structures of the present invention, advantageously contain the carbonaceous fibers all along the outside surface of the panels. It has been surprisingly found that when the panels are in direct contact with flames the fibers will puff out of the panel and form a radiation barrier and flame shield. The panel can comprise one or more plies of compressed composites that are joined together adhesively or by further compression forming. The outside of the pan panel may have attached or connected a fluff or batting of fibrous material such as described in U.S. patent application Ser. No. 918,738, entitled "Sound and Thermal Insulation", filed 10/14/86, by McCullough et al., as a sound and thermal barrier.

The carbonaceous fiber material which is utilized in the composite structures of this invention may be classified into three groups depending upon the particular use and the environment that the structures in which they are incorporated are placed.

In a first group, the non-flammable non-linear carbonaceous fibers are non-electrically conductive and possess no anti-static characteristics.

The term non-electrically conductive as utilized in the present invention relates to a resistance of greater than $10^7$ ohms per inch on a 6K tow formed from precursor fibers having a diameter of about 4 to 20 microns.

In a second group, the non-flammable non-linear carbonaceous fibers are classified as being partially electrically conductive (i.e., having low conductivity) and have a carbon content of less than 85%. Low conductivity means that a 6K tow of fibers has a resistance of about $10^7$ to $10^4$ ohms per inch. Preferably, the carbonaceous fibers are derived from stabilized acrylic fibers and possesses a percentage nitrogen content of from about 18 to 20% for the case of a copolymer acrylic fiber. This group of fibers is preferable for use on aircraft as the sound and thermal insulation and for incorporation into the matrix.

In a third group are the fibers having a carbon content of at least 85%. These fibers are characterized as being highly conductive. That is, the resistance is less than 10 ohms per inch and are useful.

The three-dimensional shaped composite structures comprising a thermosetting or thermoplastic resin and the carbonaceous fibers of this invention can be made substantially more readily than heretofore using standard compression techniques known in the art. When the longer, more flexible carbonaceous fibers of the present invention are incorporated into thermoplastic and thermosetting resin systems, the flexible fibers will process at much greater lengths than traditional carbon fibers and consequently, the composite material will have higher strengths at equivalent fiber loadings, and the ability to bend in a tighter arc (shaper angle) than other reinforced carbon composite systems. It is believed that the coil-like or sinusoidal shaped carbonaceous fibers allows the fibers increased processability than other straight fibers.

Depending on the particular purpose for which the composite material of this invention is to be used, if desired the composite may include additives such as fillers, pigments, fire retardants, biostabilizers, light stabilizers, and antioxidants. Specific examples of the above additives are calcium carbonate, calcium silicate, silica, alumina, carbon black, and titanium oxide.

As will be apparent to those skilled in the art, the reinforcing fibers used in this invention may be subjected to a process to convert them into a usually available form such as a fluff-making process prior to combining with the resin. Or before combining with the resin matrix, the fiber may be treated with various treating agents, such as for reducing or improving bonding between the fiber and resin.

It is understood that all percentages as herein utilized are based on weight percent.

The precursor stabilized acrylic filaments which are advantageously utilized in preparing the heat set carbonaceous fibers of the invention are selected from the group consisting of acrylonitrile hompolymers, acrylonitrile copolymers and acrylonitrile terpolymers.

The copolymers and terpolymers preferably contain at least about 85 mole percent of acrylic units, preferably acrylonitrile units, and up to 15 mole percent of one or more monovinyl units copolymerized with styrene, methylacrylate, methyl methacrylate, vinyl chloride, vinylidene chloride, vinyl pyridene, and the like.

Examplary of the products which can be structures of the present invention are set forth in the following examples. It is understood that the percentages referred to herein relate to percent by weight.

EXAMPLE 1

A. Battings were made by blending an appropriate weight percent of each respective opened fiber in a blender/feed section of a sample size 12" Rando Webber Model B manufactured by Rando Machine Corp. of Macedon, N.Y. The battings produced typically were 1 inch (2.54 cm) thick and had bulk densities in a range of from 0.4 to 6 lb/cc ft (6.4 cm to 96 kg/cc $m^3$). The battings were thermally bonded by passing the Rando batting on a conveyor belt through a thermal bonding oven at a temperature of about 300° F.

B. The battings from part A were immediately taken and formed into panels by compression on a standard flat plate press at a pressure of 10,000 lb/$ft^2$ to form panels of ¼" thickness.

Flammability tests were run according to the procedure of the Ohio State Burn test which is set forth in FAR 25.853 which was disclosed in the results shown in the following Table I with regard to the battings formed by the procedure of Part A:

TABLE I

| Sample No. | Sample Composition | % Wt. | Pass or Fail |
|---|---|---|---|
| 1 | NCF/PEB/PE | 10/20/70 | passed |
| 2 | NCF/PEB/PE | 20/20/60 | passed |
| 3 | NCF/PEB/PE | 25/20/55 | passed |
| 4 | NCF/PEB/PE | 30/20/50 | passed |
| 5 | NCF/PEB/PE | 40/20/40 | passed |
| 6 | NCF/PEB/PE | 5/20/75 | failed |
| 7 | NCF/PEB/PE | 50/20/30 | passed |
| 8 | OPF/PEB/PE | 10/20/70 | failed |
| 9 | LCF/PEB/PE | 50/20/30 | passed |
| 10 | NCF/PEB/Cotton | 10/10/80 | passed |
| 11 | Nomex TM /PEB/PE | 20/20/60 | failed |
| 12 | Nomex TM /PEB/PE | 50/20/30 | failed |
| 13 | NCF/PEB/Cotton | 10/15/75 | passed |
| 14 | NCF/PEB/Cotton | 5/15/80 | failed |
| 15 | NCF/PEB/PE | 5/20/75 | failed |
| 16 | NCF/PEB/PE | 7.5/20/72.5 | borderline |
| 17 | LCF/PEB/Cotton | 25/15/60 | passed |
| 18 | OPF/PEB/Cotton | 50/15/35 | failed |
| 19 | NCF/PEB/Cotton | 20/15/65 | passed |
| 20 | NCF/PEB/Wool | 5/15/80 | failed |
| 21 | NCF/PEB/Wool | 10/15/75 | passed |
| 22 | NCF(sc)/PEB/Cotton | 20/15/65 | passed |
| 23 | OPF/PEB/PE | 50/20/30 | failed |

NCF = non-linear carbonaceous fiber
LCF = linear carbonaceous fiber
LCF(SC) = linear carbonaceous fiber with small amplitude crimp
PEB = 8 denier polyester binder fiber of 410 KODEL(Trademark)
PP = polypropylene
PE = 6 denier 2" staple Dupont DACRON (Trademark) 164 FOB polyester
Cotton = non-treated 1½" cotton
OPF = stabilized polyacrylonitrile fiber
NOMEX = trademark of an aramid fiber available from E. I. duPont & Co.

EXAMPLE 2

Following the procedure of Example I similar tests were performed on panels of ⅛" to 3/16" thickness prepared according to the results as shown in the following Table II.

TABLE II

| Sample No. | Sample Comp. | Composition | Pass or Fail |
|---|---|---|---|
| 1 | NCF/PEB/PE | 30/20/51 | passed |
| 2 | NCF/PEB/PE | 30/20/50 | passed |
| 3 | Nomex TM /PEB/PE | 20/20/60 | failed |
| 4 | Nomex TM /PEB/PE | 50/20/30 | failed |
| 5 | NCF/PEB/PE | 20/20/60 | passed |
| 6 | LCF/PEB/PE | 50/20/30 | passed |

EXAMPLE 3

Following the procedure of Example 1 the Ohio State Burn Test was performed wherein a standard foam which is used in airplane upholstery as described in FAR 25.853 appendix F Part 25 was covered with panels of the invention and subjected to direct flame.

The results are as follows:

TABLE III

| Sample No. | Panel | Results |
|---|---|---|
| 1 | foam alone | failed |
| 2 | NCF*/glass screen/NCF* | passed |
| 3 | NCF**/NCF** | passed |
| 4 | NCF** | passed |
| 5 | NCF*/FR Cotton/NCF* | passed |

TABLE III-continued

| Sample No. | Panel | Results |
|---|---|---|
| 6 | (NCF/NCF/NCF)*** | passed |

*77% NCF/23%/PEB
**50% NCF/20% PEB/30% PE
***20% NCF/20% PEB/60% PE

What is claimed is:

1. A fire retarding, radiation and fire shielding structural panel, comprising at least one compression formed composite composed of a thermoplastic or thermosetting resin matrix containing about 10 to 95% by weight of non-flammable non-graphitic carbonaceous non-linear fibers having an L.O.I value of greater than 40, said fibers having a reversible deflection ratio of greater than 1.2:1 and an aspect ratio (1/d) of greater than 10:1, said panel having carbonaceous fibers on at least one surface whereby when the panel is in direct contact with flames at said surface, the fibers puff out of the panel on said surface and form a radiation barrier and flame shield.

2. The structural panel of claim 1, wherein the fibers have a sinusoidal configuration.

3. The structural panel of claim 1, wherein the fibers have a coil-like configuration.

4. The structural panel of claim 1, wherein said fibers are in the form of a batting prior to compression.

5. The structural panel of claim 1, wherein said fibers are derived from acrylic fibers.

6. The structural panel of claim 1 wherein the carbonaceous fibers are derived from stabilized acrylic fibers and have a nitrogen content of about 18 to 20%.

7. The structural panel of claim 1 wherein said matrix comprises a thermoplastic selected from the group consisting polyolefin and polyester.

* * * * *